United States Patent [19]

Taquoi

[11] 4,381,062

[45] Apr. 26, 1983

[54] CONTAINER

[75] Inventor: Jean-Pierre Taquoi, Soissons, France

[73] Assignee: B.S.L. (Bignier Schmid-Laurent), France

[21] Appl. No.: 248,503

[22] Filed: Mar. 27, 1981

[30] Foreign Application Priority Data

Apr. 30, 1980 [FR] France ..... 80 09816

[51] Int. Cl.[3] ..... B65D 7/42; B65D 87/00

[52] U.S. Cl. ..... 220/71; 220/1.5; 220/66

[58] Field of Search ..... 220/71, 1 B, 5 A, 3, 220/70, 72, 84, 66; 105/358, 360

[56] References Cited

U.S. PATENT DOCUMENTS

| | | | |
|---|---|---|---|
| 3,310,070 | 3/1967 | Black | 220/72 |
| 3,814,290 | 6/1974 | Gerhard | 222/143 |
| 3,912,103 | 10/1975 | Gerhard | 220/1.5 |
| 3,971,491 | 7/1976 | Mowatt-Larssen et al. | 220/71 |
| 4,307,812 | 12/1981 | Gerhard | 220/1.5 |

*Primary Examiner*—Steven M. Pollard
*Assistant Examiner*—D. Voorhees
*Attorney, Agent, or Firm*—Thomas J. Greer, Jr.

[57] ABSTRACT

A container comprises an elongate cylindrical vessel arranged longitudinally between two supporting frames. The cylindrical wall of the vessel is in abutment against and welded to a face of a transverse connecting plate, the opposite face thereof is in abutment against and welded to one of said supporting frames. The vessel is designed specially for powdered materials.

4 Claims, 2 Drawing Figures

CONTAINER

BACKGROUND OF THE INVENTION

Figure 2:
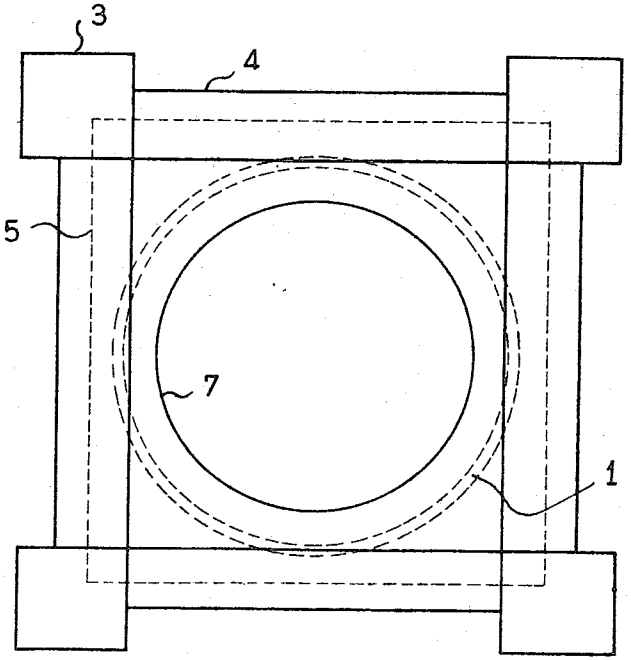

The invention relates to a container, that is to say a self-supporting rigid metal structure, comprising an elongate cylindrical vessel arranged longitudinally between two vertical supporting frames, and means connecting said vessel to said frames to form a unitary rigid structure.

These containers, which can be displaced and stacked on one another, are designed for sea, rail and road transport as well as for storage.

OBJECT OF THE INVENTION

One object of the present invention is to make it possible to use a standard frame for vessels of different diameters.

Another object of the invention is to provide a container for pulverulent material.

SUMMARY OF THE INVENTION

According to the invention, this is achieved due to the fact that said connecting means at one or each ends of the vessel comprises a transverse connecting plate having a first face and a second face opposite to said first face, said first face being in abutment against one of said supporting frame and welded thereto, said side wall at the end of the vessel being in abutment against the said second face and welded thereto.

IN THE DRAWINGS

Figure 1:
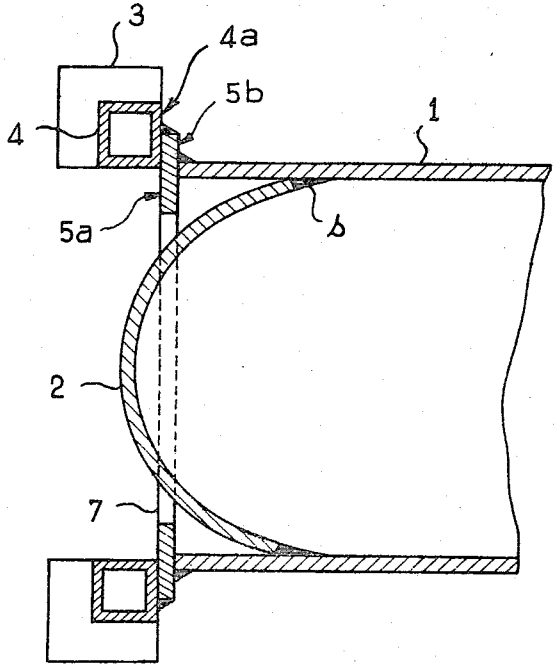

FIG. 1 shows a longitudinal section of one end of a container according to the invention, intended specially for pulverulent materials (f.i. granulated chemical fertilisers); and FIG. 2 shows an end view of the container of FIG. 1.

The container illustrated in FIGS. 1 and 2 is constituted by a horizontal cylindrical vessel which is supported by two vertical supports between which it is placed and with which it constitutes a unit.

The vessel is delimited, in a way known per se, by a cylindrical wall 1 and by two bottoms placed at the ends of this wall. FIG. 1 shows one of these bottoms constituted by a curved wall 2 located inside the wall 1 and welded to the wall 1 near the left end thereof.

At the left end, the vessel is connected to a support which is constituted, in a way known per se, by a frame, as may be seen best in FIG. 2. This frame is delimited, for example, by four blocks 3 which are located at the corners of a square and which are connected by square-section profile members 4 arranged along the sides of a square.

The vessel is connected to the frame by means of a transverse plate. According to the invention, one face 5*a* of the plate is in abutment against the frame and is welded to the faces 4*a* of the sides of the frame which are turned towards the vessel. The connection between the vessel and the plate is ensured by the lateral wall 1 of the vessel, the edge of this wall being in abutment against the face 5*b* of the plate (opposite to face 5*a*) and being welded thereto.

If necessary, the connecting plate 5 possesses a central opening 7 for the free passage of the bottom wall 2.

Similar means are provided at the other end of the container.

The invention is not limited to the embodiment which has been described. In particular, it will be noted that the end supports which are reduced to simple frames completed by plates can, if desired, be more complex and can also be connected to one another and to the vessel by means of additional connections.

I claim:

1. A container comprising a vessel having cylindrical side walls and curved end walls each of which is, respectively, secured to the interior surface of the vessel near its ends to thereby close the interior of the vessel, the ends of the cylindrical side walls of the vessel extending beyond the region of contact of each of said curved end walls with the interior surfaces of the vessel, a supporting frame at each end of said vessel, and means connecting said vessel to said frame to form a unitary structure, said connecting means comprising a connecting plate positioned in a plane substantially transverse to said cylindrical side walls and having a first face and a second face opposite to said first face, said first face being in abutment against said supporting frame and welded thereto, said ends of the cylinder side walls being in abutment against the said second face and welded thereto.

2. The container of claim 1, in which the frame is rectangular.

3. The container of claim 1, in which each transverse plate has a central opening through which extends a portion of a respective curved end wall.

4. The container of claim 3 in which the frame is rectangular.

* * * * *